US005984392A

United States Patent [19]

Iannacone, Jr.

[11] Patent Number: 5,984,392

[45] Date of Patent: Nov. 16, 1999

[54] CARPET TUCKING APPARATUS

[75] Inventor: Charles P. Iannacone, Jr., Gilbert, Ariz.

[73] Assignee: IBF Tool Company, Mesa, Ariz.

[21] Appl. No.: 08/936,015

[22] Filed: Sep. 23, 1997

[51] Int. Cl.[6] ..... A47G 27/04; B25B 27/02

[52] U.S. Cl. ..... 294/8.6; 29/270

[58] Field of Search ..... 294/8.6; 81/488; 29/270, 238, 243.5; 7/103; 156/71, 579, 582, DIG. 39

[56] References Cited

U.S. PATENT DOCUMENTS

| | | | |
|---|---|---|---|
| 2,635,332 | 4/1953 | Huntington | 29/270 |
| 2,761,199 | 9/1956 | Allen | 81/488 |
| 2,770,032 | 11/1956 | Kelly | 29/270 |
| 3,127,299 | 3/1964 | Hecht | 156/579 |
| 3,363,314 | 1/1968 | O'Brien | 30/125 |
| 3,395,453 | 8/1968 | Prater | 30/293 |
| 3,538,523 | 11/1970 | Sparks | 7/14.1 |
| 3,546,726 | 12/1970 | Bizzigotti | 7/14.1 |
| 3,621,573 | 11/1971 | Summers | 30/287 |
| 3,737,932 | 6/1973 | Armijo | 7/14.1 |
| 3,934,341 | 1/1976 | Carlson | 30/287 |
| 4,095,341 | 6/1978 | Crain | 30/287 |
| 4,314,395 | 2/1982 | Brock | 156/579 |
| 4,605,253 | 8/1986 | Anderson | 294/8.6 |
| 4,669,190 | 6/1987 | Innami et al. | 30/273 |
| 4,750,226 | 6/1988 | Costill | 7/103 |
| 4,790,059 | 12/1988 | Killpack | 29/451 |
| 4,949,604 | 8/1990 | Squires | 81/488 |
| 5,203,852 | 4/1993 | Downing et al. | 294/8.6 |

FOREIGN PATENT DOCUMENTS 7513571 5/1976 Netherlands .

*Primary Examiner*—Dean J. Kramer
*Attorney, Agent, or Firm*—Schmeiser, Olsen & Watts

[57] ABSTRACT

The present invention is an apparatus for tucking carpet. A preferred embodiment of the apparatus is provided with a base plate, a handle, and three wheels. The leading wheel sets the edge of the carpet in the gap between the wall and the tack strip, the middle wheel tucks the carpet passing beneath the base plate completely into the gap and the trailing wheel ensures uniformity. By using three wheels, the carpet can be quickly and easily tucked in a single pass, thereby saving the carpet installer precious time. In another embodiment, the position of the wheels can be adjusted in relation to the base plate. The position of the wheels is adjusted and positioned in proportion to the thickness of the carpet being tucked. This allows the carpet tucking apparatus to be used with practically any type of carpet available on the market today.

14 Claims, 8 Drawing Sheets

FIG. 3.1

CARPET TUCKING APPARATUS

BACKGROUND OF THE INVENTION

1. Field of the Invention

The present invention generally relates to the floor covering industry. More specifically, the present invention relates to the installation of carpet.

2. Description of Related Art

For comfort and aesthetic reasons, most offices, homes, and other buildings have some type of floor covering installed. One of the most popular and common types of floor coverings used in both homes and office buildings is the carpet. Carpets are not only decorative, but provide certain functional aspects as well. Most carpets are installed to provide insulation and to reduce the level of sound generated from foot traffic in a given room. There are many different styles, colors, grades, and thicknesses of carpet available on the market today with the price of the carpet being related to the abovementioned factors.

If not properly installed, any carpet, no matter how costly, may look cheap and may not provide the desired functionality for which it was installed. It is the job of a carpet installer to ensure that carpet is properly cut, positioned, and secured in place. The carpet installer's craft is to properly install carpet, but the carpet installer's goal is to make money. Carpet installers make money by installing as many square feet of carpet as possible in as little time as possible. Since most carpet installers are paid by the square foot or the square yard, the more carpet that a carpet installer can lay in a given time, the more money they will earn.

When installing carpet, the carpet installer first places a tack strip on the floor around the perimeter of the room. The tack strip is a narrow strip of wood with a series of small tacks protruding upwards. Once the carpet is installed, the tacks will press into the backing of the carpet and function to securely hold the carpet in place. The tack strip is positioned such that a gap of approximately 0.5 cm–1.5 cm is formed between the tack strip and the base of the wall or the baseboard, if a baseboard is installed. Then a carpet pad is typically sized and cut to fit just inside the perimeter of the tack strip. The carpet pad is used to provide additional cushioning for the carpet. Next, a piece of carpet is cut so as to be just slightly larger than the dimensions of the area to be carpeted.

Once the carpet has been placed over the carpet pad, the back of the carpet rests on the tack strip and the edges of the carpet are bent slightly upwards with the edges of the carpet curling upwards and resting on the wall. The carpet can then be "stretched" and "kicked" into place, using the tack strip to hold the carpet in the desired position. In order to perfect the appearance of the room and to attach the carpet to the tack strip, the carpet installer securely tucks the edge of the carpet into the gap between the tack strip and the wall. The process of tucking the carpet into the gap is one of the most time-consuming and tedious aspects of the carpet layer's job. Typically, the carpet installer uses a large, blunt, flat-edged blade with a handle to push or hammer the carpet into the gap. By moving around the edge of the carpet and pushing the blade into the carpet between the wall and the tack strip, the carpet is gradually tucked into the gap. This tucking process is difficult and the carpet installer must make several passes with the blade around the edges of the carpet in order to completely tuck the carpet into the gap.

In addition, given the goal of the tucking process and the tool being used, it can be easily understood that the typical carpet installer may inadvertently gouge or otherwise damage the baseboard or wall adjacent to the area of the carpet being tucked.

Considering the nature of the task and the stated goal of installing large quantities of carpet as quickly as possible, many tools have been developed to aid carpet installers in their trade. Unfortunately, many of these tools have inherent limitations and are not adequately suited to achieve the goal of installing more carpet in a shorter amount of time.

For example, U.S. Pat. No. 5,203,852 issued to Downing discloses a carpet tucking apparatus with a long handle attached to a single wheel. A single wheel is insufficient for tucking most carpets in a single pass, especially thicker carpets which require more force to place the carpet into the gap. Further, the long handle of the carpet tucking apparatus taught by Downing is connected at an obtuse angle to the wheel. This has a tendency to cause the handle to extend out and away from the wall. This makes it difficult for the carpet installer to supply the downward force necessary to tuck the carpet into the gap. In addition, the angle makes it hard to control the tool and the wheel may jump out of the gap, thereby causing damage to the wall or baseboard during the tucking process. While the carpet installer can make multiple passes with this tool and eventually tuck the carpet, this process consumes valuable time and reduces profitability.

Similarly, U.S. Pat. No. 4,790,059 issued to Killpack discloses a tool for tucking the edge of a carpet onto a tacking strip. This tool includes a wheel mounted on one end of a handle for tucking the carpet into the gap. The tool also includes a flat tucking blade mounted to the opposite end of the handle. Although the tool as taught by Killpack can be held at an angle, sufficient downward force cannot be applied to the carpet laying tool if held at an angle. In addition, downward force applied at an angle may cause the wheel member to slip out of the gap, thereby causing damage to the wall or baseboard. As with Downing, the carpet laying tool as taught by Killpack has a single wheel which rides over the surface of the carpet in the gap between the edge of the carpet and the wall. While somewhat effective, the single wheel can easily jump out of the gap, thereby ineffectively tucking the carpet, and causing the carpet installer to have to retuck the carpet using multiple passes.

Therefore, there exists a need for a carpet tucking apparatus that will allow the carpet installer to quickly and easily install carpets of various thicknesses without making multiple passes. Without an improved carpet tucking apparatus, carpet installers will continue to be limited by the constraints identified above and will not be able to further increase their income by tucking carpet more quickly and easily.

DISCLOSURE OF THE INVENTION

The present invention is an apparatus for tucking carpet. A preferred embodiment of the apparatus is provided with a base plate, a handle, and three wheels. Each of the three wheels passes over the edge of the carpet during the installation process to ensure that the carpet will be tucked properly. The leading wheel sets the edge of the carpet in the gap between the wall and the tack strip, the middle wheel further tucks the carpet passing beneath the base plate into the gap, and the trailing wheel gives the carpet a finished look and helps to ensure uniformity. By using three wheels, the carpet is quickly and easily tucked in a single pass, thereby saving the carpet installer precious time. In addition, the position of the wheels can be adjusted in relation to the base plate. The position of the wheels is set in proportion to the thickness of the carpet being tucked. This allows the device to be used with practically any type of carpet available on the market today.

The foregoing and other features and advantages of the invention will be apparent from the following more particular description of preferred embodiments of the invention, as illustrated in the accompanying drawings.

BRIEF DESCRIPTION OF THE DRAWINGS

The preferred embodiments of the present invention will hereinafter be described in conjunction with the appended drawings, where like designations denote like elements, and:

FIG. 3.1 is an end view of a carpet tucking apparatus with an adjustable handle according to a preferred embodiment of the present invention;

BEST MODE FOR CARRYING OUT THE INVENTION

The carpet tucking apparatus of the present invention provides a unique and effective way for carpet installers to increase the speed of carpet installation by streamlining the process of tucking carpets.

Figure 1:
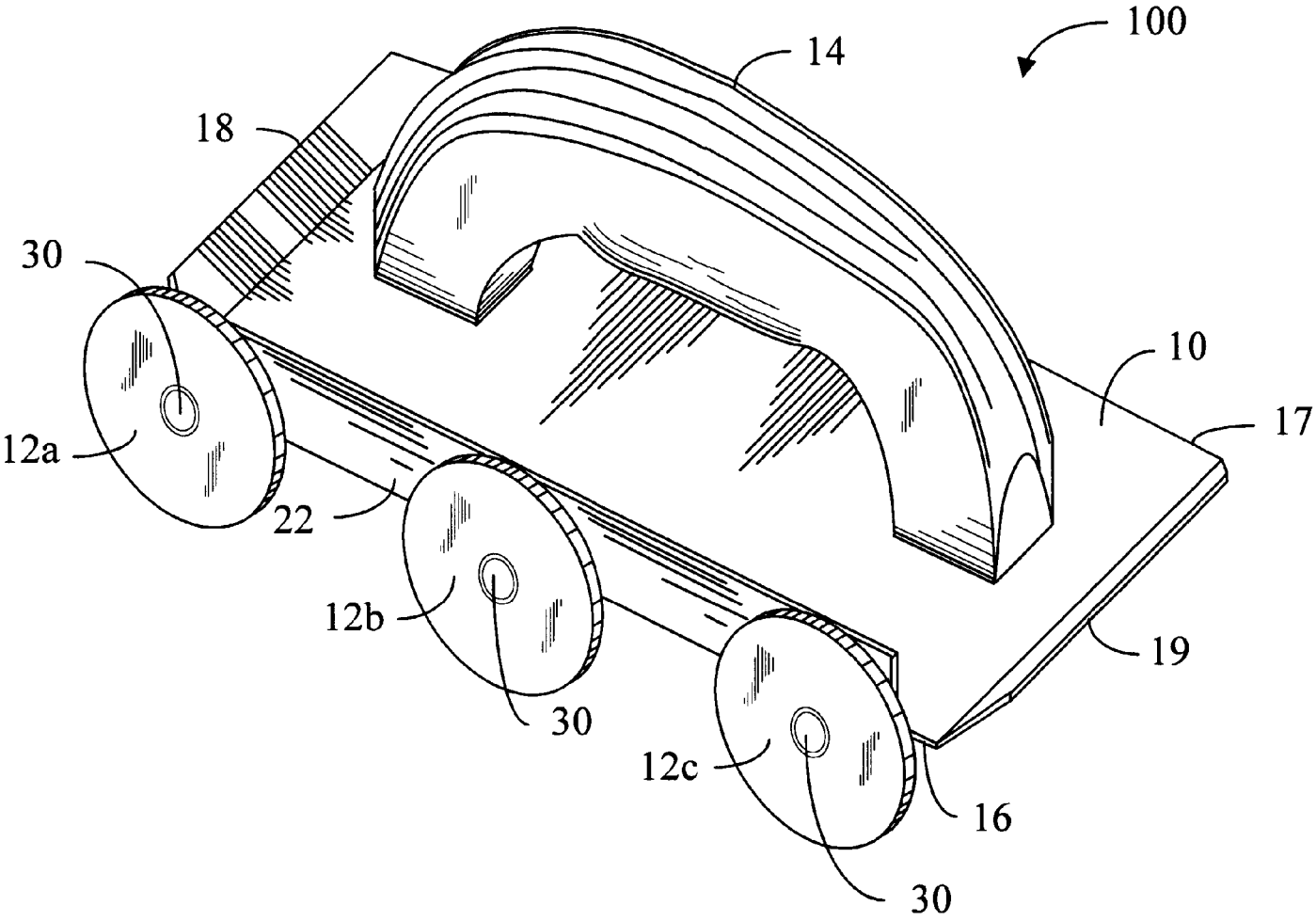
FIG. 1 is a perspective view of a carpet tucking apparatus according to a preferred embodiment of the present invention.

Referring now to FIG. 1 a carpet tucking apparatus 100 according to a preferred embodiment of the present invention includes a base plate 10, wheels 12*a*, 12*b*, and 12*c* (collectively, wheels 12), a handle 14, long edges 16 and 17, end flanges 18 and 19, an edge flange 22 and wheel attachment mechanisms 30.

Base plate 10 is a substantially rectangular flat plate, having a pair of long edges 16 and 17, and a pair of end flanges 18 and 19. End flanges 18 and 19 are an extension of base plate 10 and the plane of end flanges 18 and 19 form an upward angle with respect to base plate 10. The angle formed by end flanges 18 and 19 is approximately 30–40°. While 30–40° is the most preferred angle for end flanges 18 and 19, other angles, greater or lesser may be successfully employed. End flanges 18 and 19 are provided so as to allow base plate 10 to move across the surface of a carpet without binding, whether carpet tucking apparatus 100 is moved in a forward or a backward direction. Therefore, any angle which successfully accomplishes this goal is acceptable. Further, although other shapes may also be used for base plate 10, the most preferred shape is rectangular.

Edge flange 22 is also an extension of base plate 10 and is formed so as to be substantially perpendicular to the surface of base plate 10. Edge flange 22 is provided as an attachment point for wheels 12. Handle 14 has an arc-like shape and is mounted so the hand of the carpet installer is approximately centered over base plate 10 when gripping handle 14. By mounting handle 14 in this location, the carpet installer can grip carpet tucking apparatus 100 and impart the necessary downward force to cause carpet tucking apparatus 100 to slide across the surface of the carpet while simultaneously forcing the carpet into the gap between the wall and the tack strip.

Wheels 12 are preferably made of a hard, durable material such as plastic, nylon, or other synthetic material. While various metals may be used, plastic or other similar material is preferred for the wheels because metal wheels may inadvertently cause damage to the carpet, the wall, or any decorative baseboard attached to the wall. Wheels 12 are rotatably mounted to edge flange 22 and, by extension, to base plate 10 by a suitable connection mechanism such as bolts, screws, or similar fasteners. It is important to note that wheels 12 should rotate freely about a central axis in order to maximize performance of carpet tucking apparatus 100. In addition, wheels 12 are preferably mounted in the same vertical plane and substantially perpendicular to base plate 10 to provide more control in straight line movement of carpet tucking apparatus 100. Wheels 12 are attached to edge flange 22 by wheel attachment mechanisms 30. Wheel attachment mechanisms 30 may include any type of fastener suitable for rotatably attaching wheels 12 to edge flange 22. In one preferred embodiment, wheel attachment mechanisms 30 are counter sunk bolt and nut assemblies. Other fasteners known to those skilled in the art may also be used.

Figure 2:
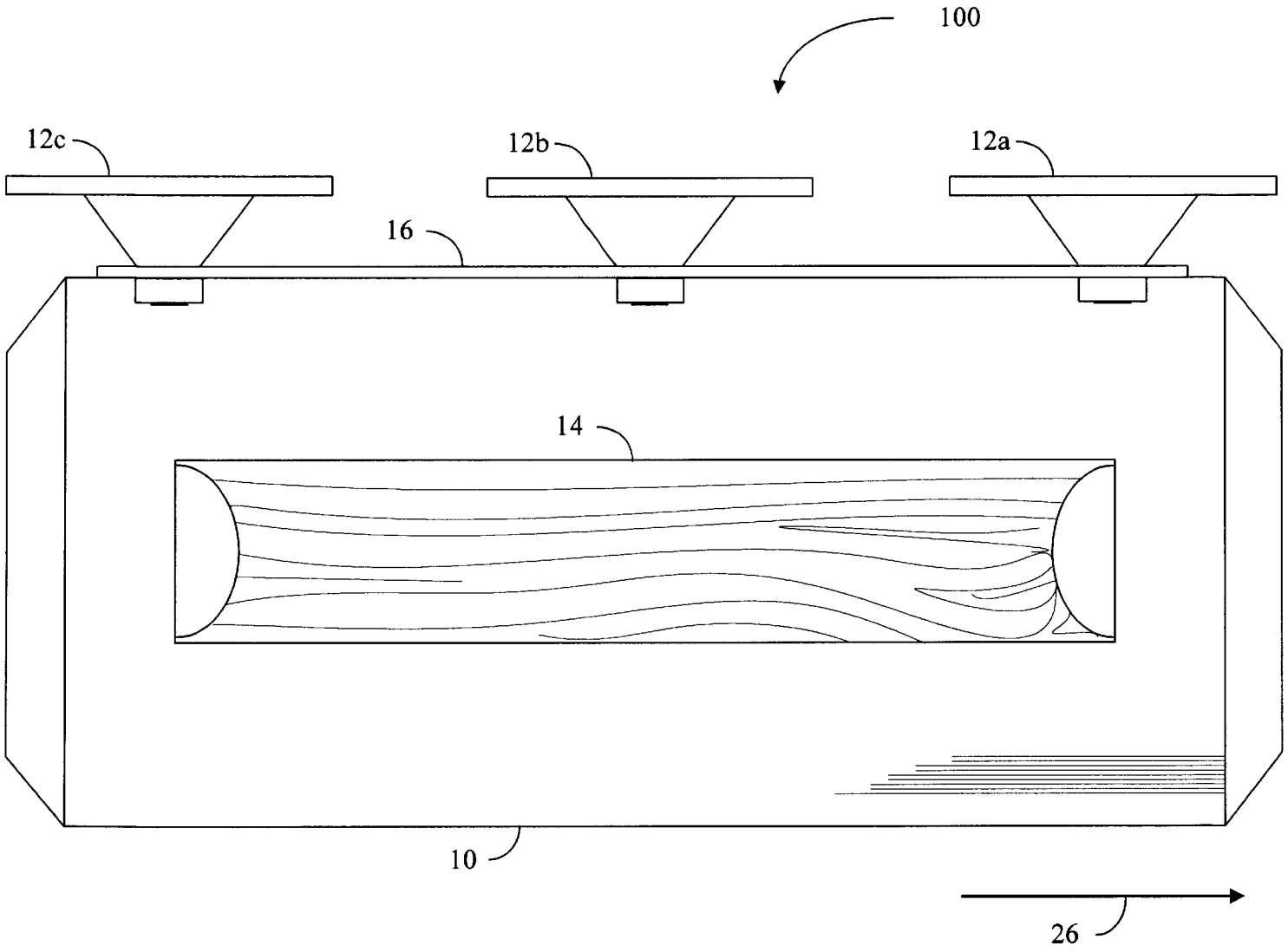
FIG. 2 is a top view of the carpet tucking apparatus of FIG. 1.

Referring now to FIG. 2, wheels 12 are positioned along long edge 16 of base plate 10. Three wheels are preferred since two wheels are generally not sufficient for tucking carpet and four wheels are unnecessary. Assuming that carpet tucking apparatus 100 is being pushed along a carpet in the direction indicated by arrow 26, leading wheel 12*a* sets the carpet in the gap between the wall and the tack strip, middle wheel 12*b* further forces the carpet into the gap and trailing wheel 12*c* gives the carpet a finished look. Using a preferred embodiment of the present invention, this tucking operation is similar to making three separate passes with a more traditional carpet tucking apparatus.

Figure 3:
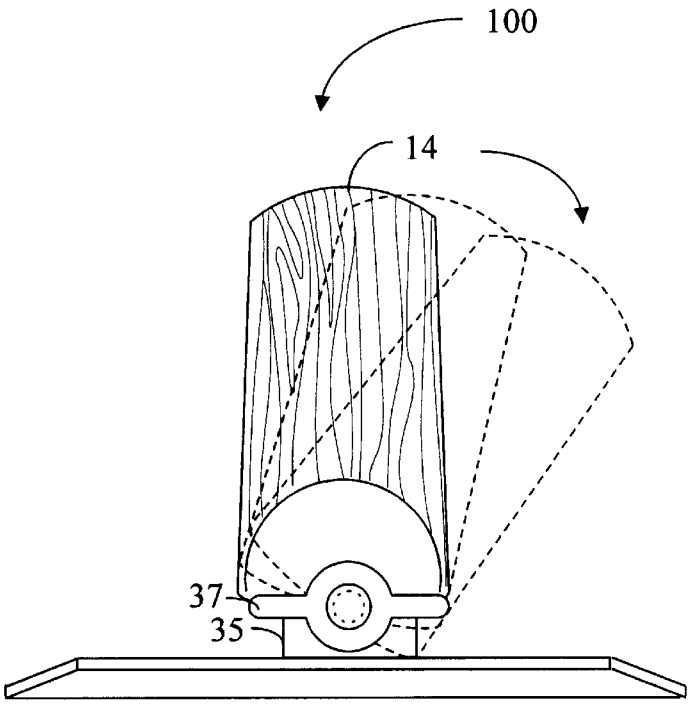
FIG. 3 is an end view of the carpet tucking apparatus of FIG. 1.
Figure 3:
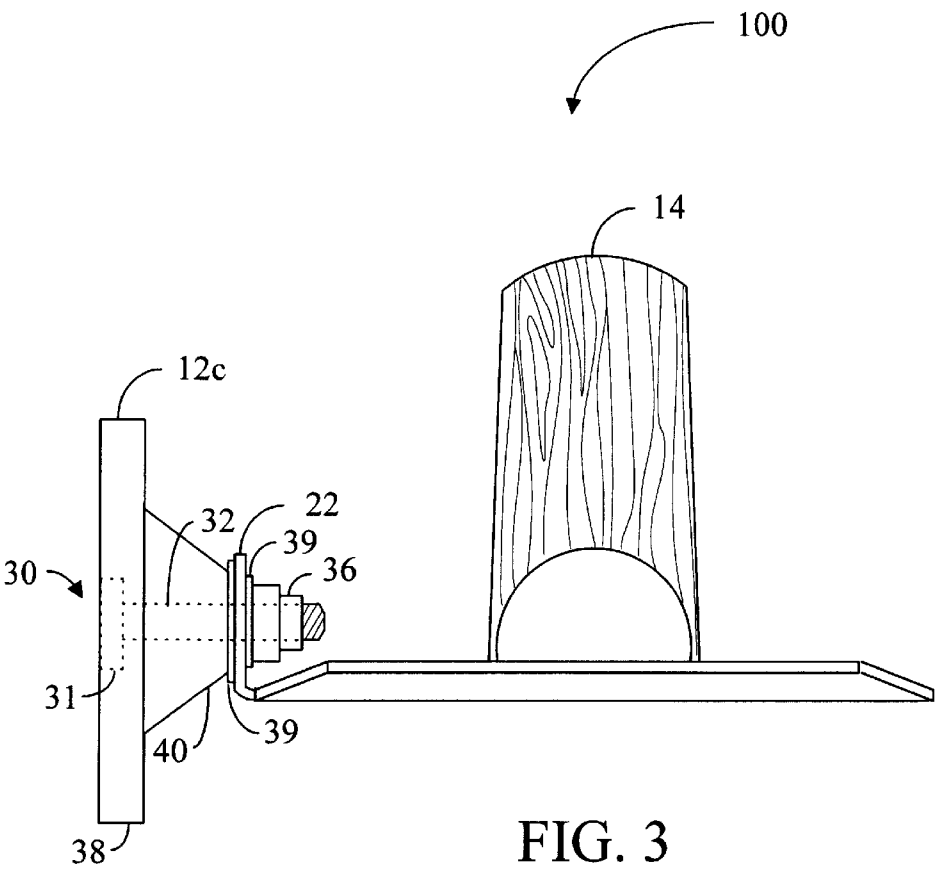

Referring now to FIG. 3, each wheel attachment mechanism 30 (depicted here as a nut and bolt assembly) has a head 31, a shaft 32, and a nut 36. The head 31 of wheel attachment mechanism 30 does not protrude beyond wheel 12*c*. Rather, wheel attachment mechanism 30 is countersunk or positioned such that head 31 of wheel attachment mechanism 30 is slightly recessed within wheel 12*c*. Since the wheels rotate with respect to base 10 without head 31 protruding, inadvertent damage to the baseboard can be avoided. Also shown in FIG. 3, a nut 36 secures each wheel attachment mechanism 30, and in turn, each wheel 12 to base plate 10. Each wheel 12 is comprised of a circular portion 38 and a hub portion 40. Hub portion 40 is a truncated cone which has a large outer diameter that tapers into a smaller inner diameter and will typically include a throat portion which may extend through an aperture in side flange 22. Optional washers 39 may be included so as to enhance the rotational capabilities of each wheel attachment mechanism 30.

Referring now to FIG. 3.1, a portion of an alternative preferred embodiment of carpet tucking apparatus 100 is illustrated (wheel assembly not shown). In this embodiment, handle 14 is mounted on a handle post 35. A wing nut 37 is used to attach handle 14 to handle post 35. In this configuration, by loosening wing nut 37 and rotating handle 14, handle 14 may be positioned at various different angles relative to base plate 10. This allows the carpet installer to adjust the position of handle 14 for maximum comfort and convenience. This can be especially important for certain installations where it is desirable for the carpet installer to position handle 14 away from the baseboard or wall in order to avoid skinning the knuckles.

Figure 4:
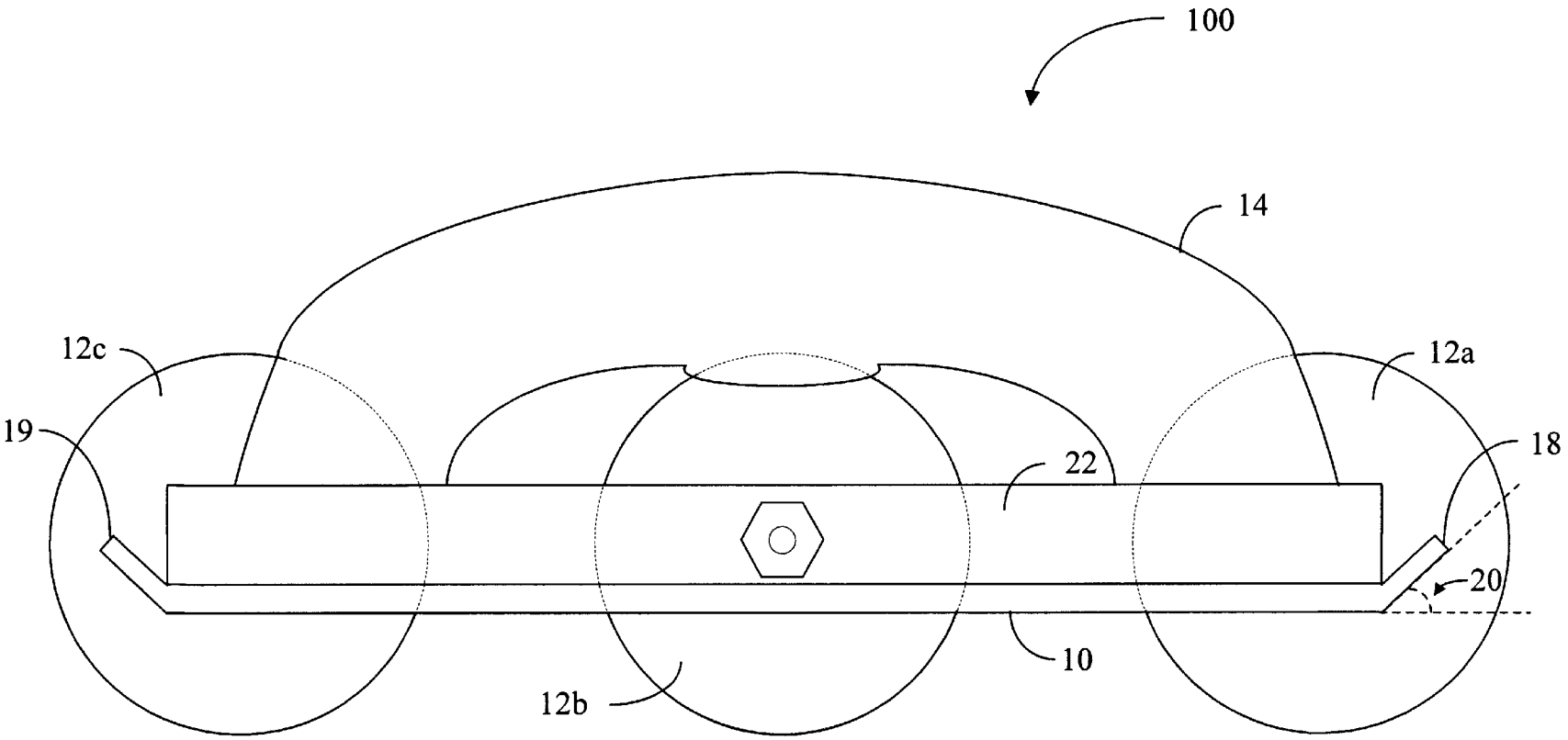
FIG. 4 is a side view of one side of the carpet tucking apparatus of FIG. 1.

Referring now to FIG. 4, a side view of carpet tucking apparatus 100 illustrates the operation of end flanges 18 and 19. End flanges 18 and 19 are angled slightly upwards with each end flange forming an upward angle 20 with a measure of approximately 30–40° in relation to the surface of base plate 10. Angled end flanges 18 and 19 allow base plate 10 to slide easily across the surface of a carpet without any undue binding or gouging into the surface of the carpet. Without providing end flanges 18 and 19, the edges of base plate 10 would have a tendency to dig into or catch on the surface of the carpet when pressure is applied to carpet tucking apparatus 100 as the carpet installer slides carpet tucking apparatus 100 along the surface of a carpet. Since end flanges 18 and 19 are located at either end of carpet tucking apparatus 100, carpet tucking apparatus 100 slides easily in both a forward and a backward direction. End flanges 18 and 19 eliminate the need to turn carpet tucking apparatus 100 around in the unlikely event that a portion of the installed carpet needs to be retucked. In addition, with both end flanges 18 and 19 in place, carpet tucking apparatus 100 can be easily operated using either the left hand or the right hand. End flanges 18 and 19 are preferably formed by bending the leading and trailing edges of base plate 10 slightly upwards to form the appropriate angle. Although not preferred, it is also possible to attach separate flange pieces to base plate 10 if desired.

Figure 5:
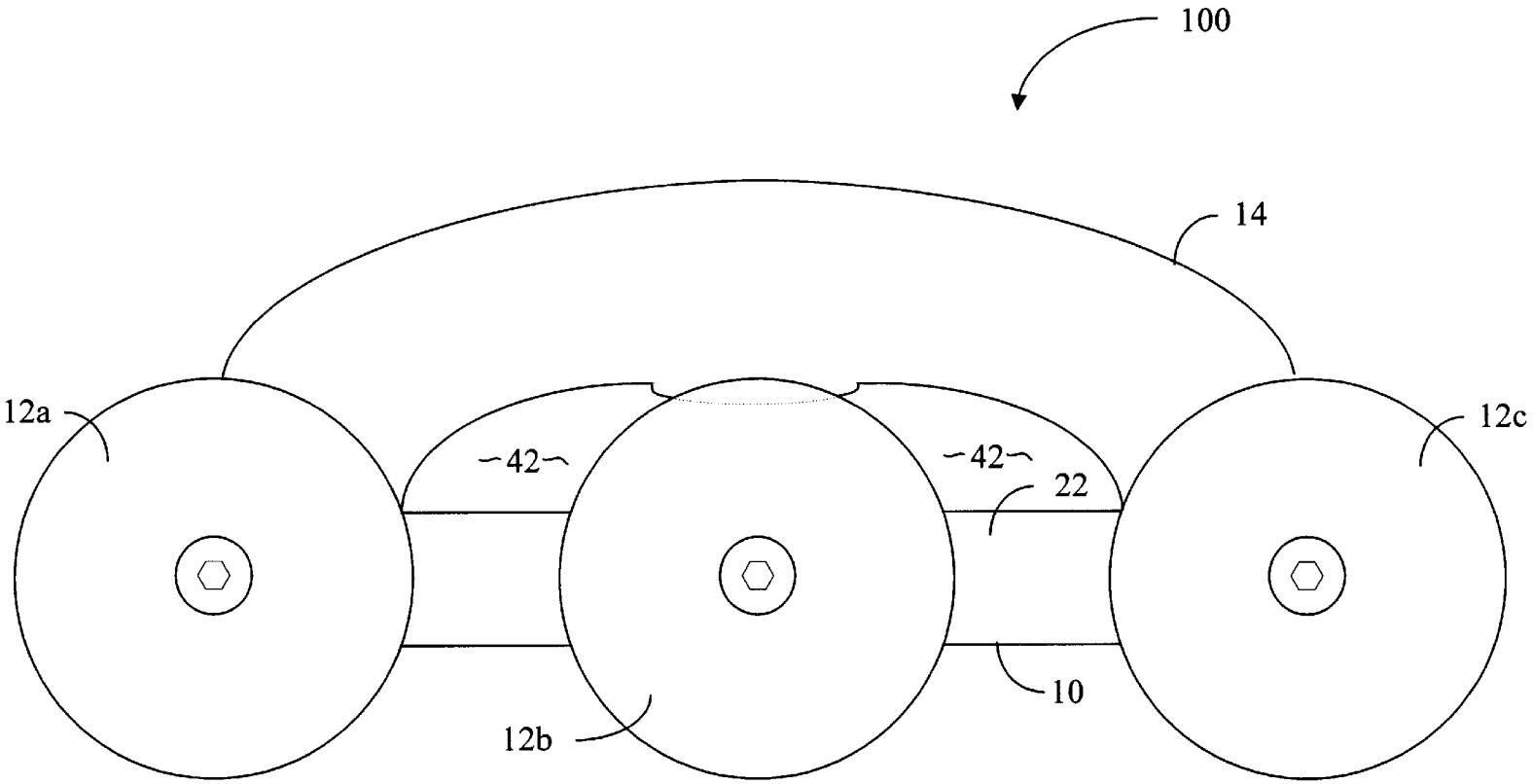
FIG. 5 is a side view of the other side of the carpet tucking apparatus of FIG. 1.

Referring now to FIG. 5, arc-shaped handle 14 creates an opening 42 between handle 14 and base plate 10. The carpet installer can easily grasp handle 14 by placing the palm of the hand and the thumb (not shown) on handle 14 and extending the fingers through opening 42, to wrap around the handle. Opening 42 allows the fingers to be comfortably inserted around handle 14 without the danger of coming in contact with moving wheels 12 and allows the carpet installer to obtain the grip needed to apply the necessary downward force required for tucking carpet. While other shapes and configurations of handle 14 may be used, an arc-shaped handle is preferred because it is easily grasped and is comfortable to use over long periods of time. Optional finger grooves or knurled portions may be included.

Figure 6:
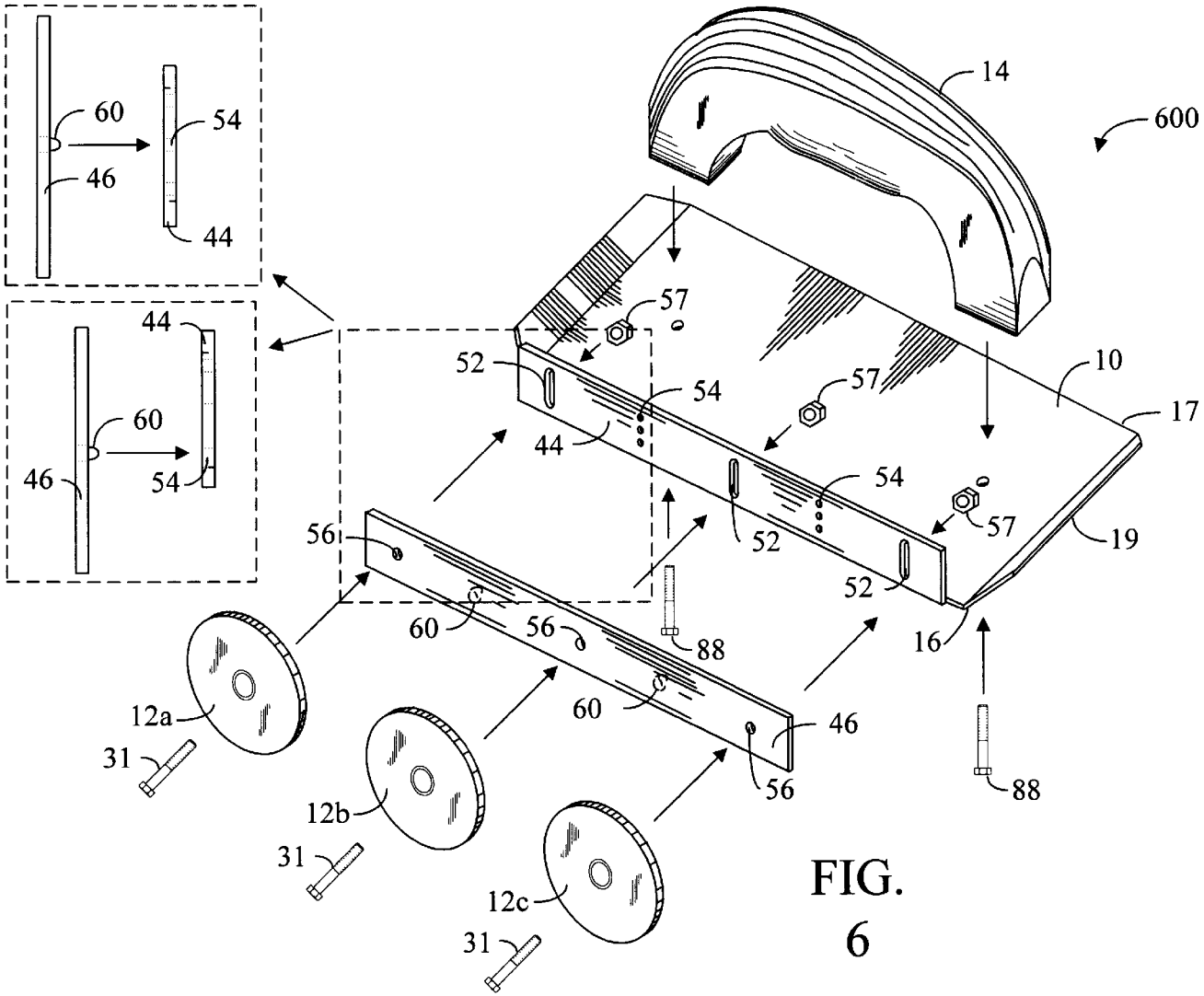
FIG. 6 is an exploded view of an alternative preferred embodiment of the present invention.

Referring now to FIG. 6, a carpet tucking apparatus 600 according to an alternative preferred embodiment of the present invention is shown. Carpet tucking apparatus 600 incorporates all major components of carpet tucking apparatus 100 and additionally includes a mechanism for adjusting the location of wheels 12 with respect to base plate 10. As before, handle 14 is attached to base plate 10 by attachment mechanisms 88. In this embodiment, attachment mechanisms 88 are illustrated as bolts. However, any fastening device known to those skilled in the art may be used. In this embodiment, a guide flange 44 is connected to long edge 16 of base plate 10. Guide flange 44 is substantially similar to edge flange 22 as illustrated in FIG. 1. However, guide flange 44 also includes three elongated slots 52 and two sets of adjustment dimples 54. Carpet tucking apparatus 600 also includes an adjustment flange 46. Adjustment flange 46 has three apertures 56 which are positioned to line up with elongated slots 52 on guide flange 44. Adjustment flange 46 also includes two alignment protrusions 60.

During assembly of carpet tucking apparatus 600, adjustment flange 46 is positioned between wheels 12 and guide flange 44. As shown in FIG. 6, a plurality of wheel attachment mechanisms 30 are used to attach wheels 12 to guide flange 44. Wheel attachment mechanisms 30 are once again depicted as counter sunk bolts 31 and nuts 57 so as to minimize the possibility of collateral damage that may result from unnecessary protrusions on carpet tucking apparatus 600. Bolts 31 pass through wheels 12, through apertures 56 in adjustment flange 46, and through elongated slots 52 on guide flange 52. At this point, nuts 57 engage the threads on bolts 31 and are tightened in place. Bolts 31 include a threaded portion for engaging nuts 57 and an unthreaded shank portion. When nuts 57 are completely tightened, the unthreaded shank portions function as axles, allowing wheels 12 to spin freely.

As shown in FIG. 6, guide flange 44 is substantially perpendicular to base plate 10 and is mounted parallel to long edge 16 of base plate 10. Elongated slots 52 are spaced equally along the face of guide flange 44. Each set of adjustment dimples 54 is a column of three circular dimples, where each column is positioned parallel to elongated slots 52 and centered between elongated slots 52. Adjustment dimples 54 are positioned so as to be vertically aligned with alignment protrusions 60 located on adjustment flange 46. Adjustment dimples 54 aid the carpet installer when assembling carpet tucking apparatus 600 and when adjusting the location of wheels 12.

As illustrated in FIG. 6, adjustment flange 46 is situated between guide flange 44 and wheels 12. Adjustment flange 46 is substantially rectangular and has three circular apertures 56 equally spaced along the face of adjustment flange 46 and positioned so as to line up with elongated slots 52 on guide flange 44. Adjustment flange 46 is positioned between 12 wheels and guide flange 44 such that the apertures of the adjustable flange 56 are in line with the elongated slots of the guide flange 52 and the apertures in wheels 12. Alignment protrusions 60 are centered on adjustable flange 46 between circular apertures 56. Alignment protrusions 60 are sized so as to fit snugly into adjustment dimples 54 and, as explained below, will aid the carpet installer in positioning adjustment guide flange 46.

Carpets come in many different colors, patterns, materials and thicknesses. Carpet tucking apparatus 600 the position of wheels 12 to be adjusted in proportion to the thickness of the carpet which is to be tucked. In order to properly tuck the carpet, the entire surface area of the bottom of base plate 10 should be in contact with the surface of the carpet while the distance between the bottom of the plate and the outer edge of each wheel 12 should be proportional to the thickness of the carpet. The position of wheels 12 may be adjusted by altering the position of adjustment flange 46 so that the surface area of the bottom of base plate 10 is evenly pressed onto the surface of the carpet while wheels 12 are positioned over the gap between the tack strip and the wall. Thicker carpets require a greater distance between the bottom of the base plate and the outer edge of the wheel while thinner carpets require a smaller distance between the bottom of the base plate and the edge of the wheel. Adjustment flange 46 and guide flange 44 allow wheels 12 to be positioned in proportion to the thickness of the carpet so that any thickness of carpet can be tucked appropriately with only a single pass. This unique feature provides the carpet installer with the capability of installing more carpet in a shorter period of time, thereby increasing the carpet layer's profitability.

The first step in adjusting the location of wheels 12 is to loosen nut 57 on each of the bolts which extends through guide flange 44. After loosening each nut 57, adjustment plate 46 is no longer rigidly held in place and can now be repositioned. Adjustment dimples 54 on guide flange 44 are provided in order to aid the carpet installer in positioning adjustment flange 46. Adjustment flange 46 can be adjusted into any position so long as both alignment protrusions on adjustment flange 46 is located in an adjustment dimple 54 in guide flange 44. In order for wheels 12 to located correctly, each alignment protrusion 60 on adjustment flange 46 must be placed into an adjustment dimple 54 that lies on the same horizontal plane in guide flange 44. For example, both alignment protrusions 60 should be placed in their respective top adjustment dimple or, alternatively, both alignment protrusions 60 should be placed in their middle adjustment dimple. When adjustment flange 46 is properly positioned, alignment protrusions 60 will be in the same horizontal plane and the edges of adjustment flange 46 and guide flange 44 will be parallel. Two alternative adjustment positions for adjustment flange 46 and guide flange 44 are illustrated in the side views of FIG. 6.

Once adjustment flange 46 in is place and nuts 57 have been tightened, carpet tucking apparatus 600 is ready for use. Although carpet tucking apparatus 600 has been illustrated with two sets of three adjustment dimples 54 and two alignment protrusions 60, the number of adjustment dimples 54 and alignment protrusions 60 can be increased or decreased to establish the adjustability of carpet tucking apparatus 600.

Figure 7:
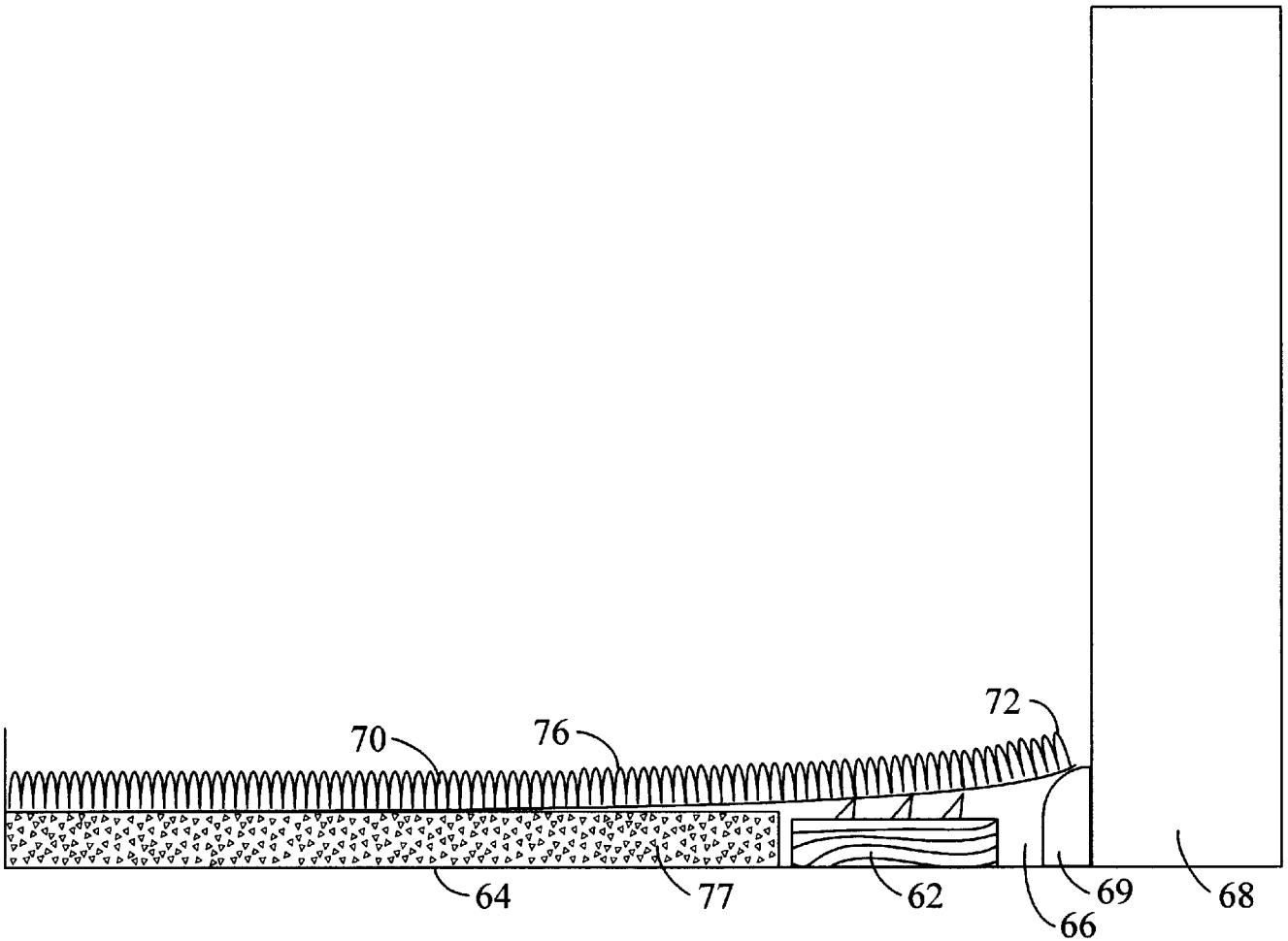
FIG. 7 is a side view of the position of a carpet section before the carpet tucking apparatus of FIG. 1 has been used to tuck the carpet.

Referring now to FIG. 7, a carpet 70 is shown resting on a pad 77 and a tack strip 62. An edge 72 of carpet 70 curls slightly upward and rests on top of baseboard 69. It should be noted that FIG. 7 represents a cross-sectional view of a small portion of a room where carpeting will be installed. FIG. 7 shows the appearance of a carpet previously sized and cut to fit and now ready to be tucked in place by a carpet installer using a carpet tucker 100 according to a preferred embodiment of the present invention. As explained above, a tack strip 62 is placed on floor 64 around the perimeter of the room or area where carpet 70 is to be installed. Tack strip 62 is positioned such that a gap 66 is formed between tack strip 62 and an optional baseboard 69 attached to wall 68. When laid on pad 77, carpet 70 lightly rests on tack strip 62 with edge 72 of carpet 70 curling upwards. In order to secure carpet 70 to tack strip 62 and provide the desired finished appearance for the room, the carpet installer must tuck edge 72 of carpet 70 into gap 66 between tack strip 62 and optional baseboard 69.

Figure 8:
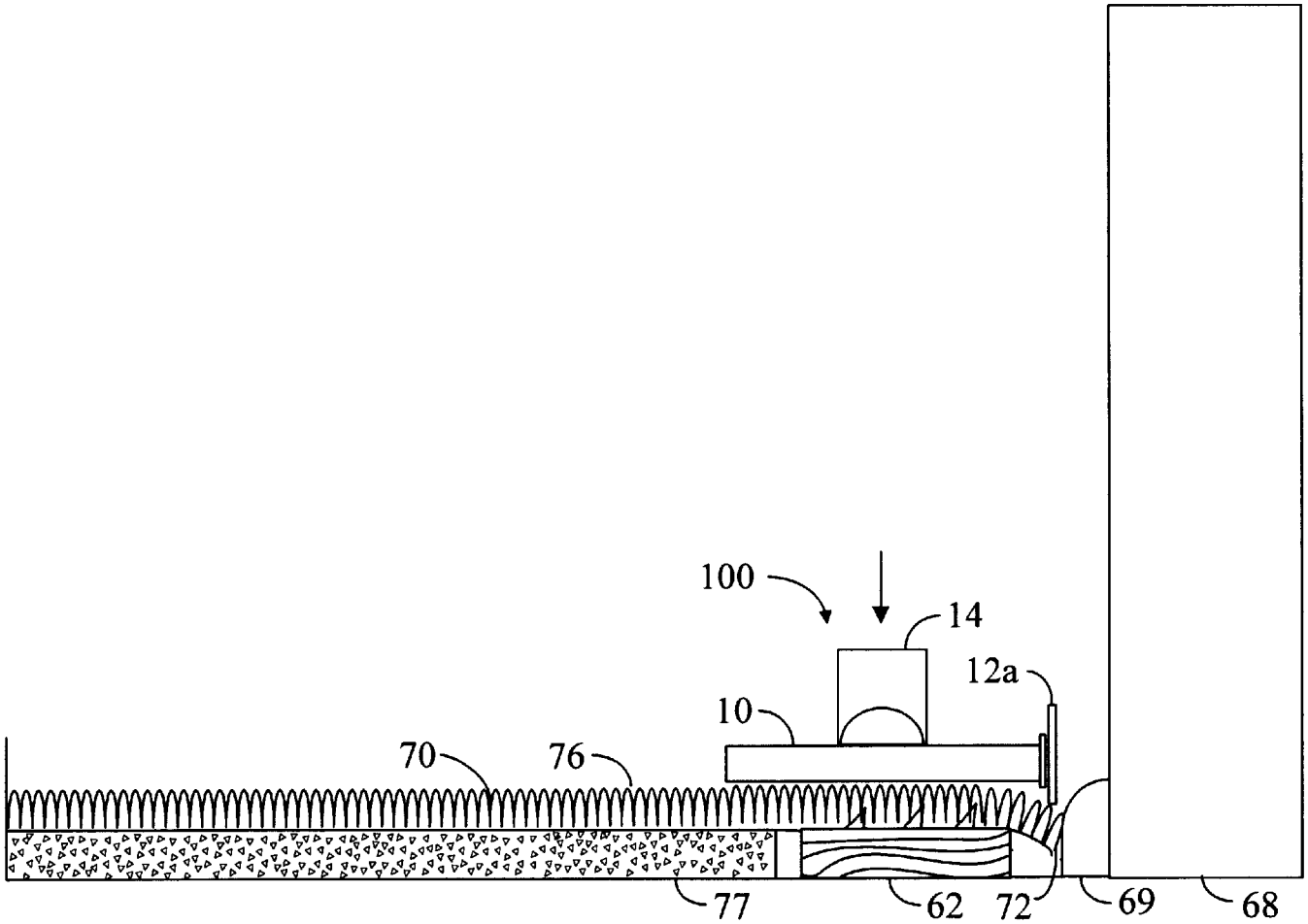
FIG. 8 is a side view of the carpet of FIG. 7 after the carpet tucking apparatus of FIG. 1 has been used to tuck the carpet.

Referring now to FIG. 8, carpet 76 is shown in conjunction with carpet tucking apparatus 100. The carpet installer initially places wheels 12 of carpet tucking apparatus 100 on the surface of carpet 76, over gap 66 between tack strip 62 and baseboard 69 with wheels 12 being in a line parallel to wall 68. Initially, the carpet installer will grasp handle 14 and provide downward pressure to force carpet 76 into gap 66. As edge 72 of carpet 76 begins to enter gap 66, the carpet installer can provide additional force in a direction parallel with wall 68 in order to propel carpet tucking apparatus 100 forwards or backwards around the perimeter of the room.

By providing handle 14 at the center of base plate 10, the downward force supplied by the carpet installer is transferred to carpet tucking apparatus 100 at a 90° degree angle, relative to base plate 10. This downward force is transferred and can be distributed evenly and simultaneously to base plate 10 and, in turn, to wheels 12. The downward force applied by the carpet installer causes base plate 10 to compress carpet 70 against pad 77, with wheels 12 of carpet tucking apparatus 100 pushing edge 72 of carpet 70 into gap 66. The positioning of handle 14 allows the force supplied by the carpet installer to be distributed evenly, so that wheels 12 of carpet tucking apparatus 100 do not slant or tilt when positioned over gap 66, thereby preventing unwanted damage to baseboard 69 or wall 68.

Once carpet tucking apparatus 100 is properly positioned with wheels 12 over gap 66, the carpet installer can provide the pushing force necessary to propel carpet tucking apparatus 100 around the room in either direction, thereby tucking the entire carpet. The leading and trailing edges of base plate 10 form an upward angle of approximately 20°–40° with the surface 76 of carpet 70. This allows carpet tucking apparatus 100 to slide easily in either direction across surface 76 of carpet 70 without undue binding or "digging" into surface 76. The carpet installer can easily change direction of the apparatus by simply changing the direction of the force, either from pulling to pushing, or from pushing to pulling. Once carpet tucking apparatus 100 is moving, the leading wheel sets the carpet in the gap, the middle wheel tucks the carpet completely in the gap and the trailing wheel gives the carpet a finished look. The apparatus has three wheels rather than one or two wheels in order to ensure that the wheels will not jump out of gap 66 as carpet tucking apparatus 100 is propelled around the room.

The downward force applied to the apparatus by the carpet installer is transferred to carpet tucking apparatus 100 at a 90° angle with respect to the surface of the carpet beneath base plate 10. This allows the carpet installer to distribute the downward force evenly. The construction of carpet tucking apparatus 100 allows the carpet installer to supply the downward force necessary to tuck the carpet without worrying that the applied force will cause wheels 12 to slant and dig into the wall. The downward force applied to carpet tucking apparatus 100 causes base plate 10 to press the carpet downward against the underlying pad, with each portion of base plate 10 pressing down in equal proportion. As a result of this compression of the carpet against the pad compresses and wheels 12, coupled to base plate 10, will be forced downward into the gap and will remain in position in the gap as force is applied to push or pull carpet tucking apparatus 100. Harm is prevented to the baseboard since the wheels will not run out of the gap as the apparatus is propelled around the room.

While the invention has been particularly shown and described with reference to preferred embodiments thereof, it will be understood by those skilled in the art that various changes in form and details may be made therein without departing from the spirit and scope of the invention.

I claim:

1. A carpet tucking apparatus, the apparatus comprising:

a base plate, wherein the base plate comprises:

a substantially planar surface;

a leading edge; and a trailing edge;

wherein the leading edge forms an upward angle with respect to the substantially planar surface of the base plate:

a plurality of wheels rotatable connected to the base plate; and a handle connected to the base plate.

2. A carpet tucking apparatus, the apparatus comprising:

a base plate, wherein the base plate comprises:

a substantially planar surface;

a leading edge; and a trailing edge;

wherein the trailing edge forms an upward angle with respect to the substantially planar surface of the base plate:

a plurality of wheels rotatably connected to the base plate; and a handle connected to the base plate.

3. A carpet tucking apparatus, the apparatus comprising:

a base plate, wherein the base plate comprises:

a substantially planar surface;

a leading edge; and a trailing edge;

wherein the leading edge and the trailing edge each form an upward angle with respect to the substantially planar surface of the base plate:

a plurality of wheels rotatable connected to the base plate; and a handle connected to the base plate.

4. The apparatus of claim 3 wherein the angular measurement of the upward angle is approximately 25°.

5. A carpet tucking apparatus, the apparatus comprising:

a base plate, the base plate comprising a substantially planar surface, a leading edge and a trailing edge; wherein the leading edge and the trailing edge each form an upward angle with respect to the substantially planar surface of the base plate;

three wheels rotatably connected to the base plate; and a handle connected to the base plate.

6. The apparatus of claim 5 wherein the angular measurement of the upward angle formed between the base plate and the leading and trailing edges is approximately 25°.

7. A carpet tucking apparatus, the apparatus comprising:

a base plate, the base plate having a substantially planar surface;

a guide flange connected to the base plate and being substantially perpendicular to the base plate, the guide flange further comprising a plurality of elongated slots and a plurality of dimples;

an adjustment flange, the adjustment flange further comprising a plurality of protrusions and a plurality of apertures, wherein at least one of the plurality of protrusions in the adjustment flange engage at least one of the plurality of dimples in the guide flange;

a first wheel rotatably connected to the base plate by a first connecting mechanism which passes through one of the plurality of slots in the guide flange and through one of the plurality of apertures in the adjustment flange;

a second wheel rotatably connected to the base plate by a second connecting mechanism which passes through one of the plurality of slots in the guide flange and through one of the plurality of apertures in the adjustment flange;

a third wheel rotatably connected to the base plate by a third connecting mechanism which passes through one of the plurality of slots in the guide flange and through one of the plurality of apertures in the adjustment flange; and a handle connected to the base plate.

8. The apparatus of claim 7 wherein the handle is rotatably connected to the base plate.

9. The apparatus of claim 7 wherein the base plate further comprises:

a leading edge; and a trailing edge.

10. The apparatus of claim 9 wherein the leading edge and the trailing edge form an upward angle with respect to the substantially planar surface of the base plate.

11. The apparatus of claim 10 wherein the angular measurement of the upward angle is approximately 25°.

12. A carpet tucking apparatus, the apparatus comprising:

a substantially rectangular base plate, the base plate comprising a substantially planar surface, a leading edge and a trailing edge;

wherein the leading edge of the base plate forms an upward angle in relation to the substantially planar surface of the base plate;

wherein the trailing edge of the base plate forms an upward angle in relation to the substantially planar surface of the base plate;

a handle rotatably connected to the base plate so that the center of the handle is positioned over the center of the base plate;

a substantially rectangular guide flange connected to the base plate and being substantially perpendicular to the base plate, the guide flange having three elongated slots formed in the guide flange, the guide flange further including a series of dimples;

an adjustment flange, the adjustment flange including two protrusions and three apertures being formed in the adjustment flange, wherein the two protrusions formed in the adjustment flange engage two of the series of dimples in the guide flange;

a first wheel rotatably connected to the guide flange by a first bolt and a first nut, the first bolt being inserted through an aperture in the wheel and through one of the apertures in the adjustment flange and through one of the slots in the guide flange and the first nut being securely threaded onto the first bolt;

a second wheel rotatably connected to the guide flange by a second bolt and a second nut, the second bolt being inserted through an aperture in the wheel and through one of the apertures in the adjustment flange and through one of the slots in the guide flange and the second nut being securely threaded onto the second bolt; and a third wheel rotatably connected to the guide flange by a third bolt and a third nut, the third bolt being inserted through an aperture in the wheel and through one of the apertures in the adjustment flange and through one of the slots in the guide flange and the third nut being securely threaded onto the third bolt.

13. The apparatus of claim 12 wherein the angular measurement of the upward angles formed by the leading edge and trailing edge are approximately 25°.

14. The apparatus of claim 12 wherein the first wheel and the second wheel and the third wheel are each are mounted so as to be substantially perpendicular to the substantially planar surface of the base plate.

* * * * *